US006823566B2

(12) United States Patent
Coffey

(10) Patent No.: US 6,823,566 B2
(45) Date of Patent: Nov. 30, 2004

(54) RELEASABLE RETAINING CLIP APPARATUS AND METHOD

(76) Inventor: Logan D. Coffey, 10203 Lakeview Ave. SW., Lakewood, WA (US) 98499

( * ) Notice: Subject to any disclaimer, the term of this patent is extended or adjusted under 35 U.S.C. 154(b) by 0 days.

(21) Appl. No.: 10/412,145

(22) Filed: Apr. 11, 2003

(65) Prior Publication Data

US 2003/0233739 A1 Dec. 25, 2003

Related U.S. Application Data

(60) Provisional application No. 60/372,725, filed on Apr. 11, 2002.

(51) Int. Cl.[7] ..... A45F 5/02

(52) U.S. Cl. ..... 24/579.09; 24/DIG. 31

(58) Field of Search ..... 24/DIG. 31, DIG. 37, 24/579.09, 16 PB, 30.5 P, 16 R, 17 AP, 265 R, 265 AL, 265 BC, 579.11; 292/330, 328, 323, 325; 248/74.3; 224/182, 665, 666, 671, 672, 674, 675, 668, 269

(56) References Cited

U.S. PATENT DOCUMENTS

| | | | | | |
|---|---|---|---|---|---|
| 3,855,669 | A | * | 12/1974 | Meyer | 24/16 PB |
| 3,991,444 | A | * | 11/1976 | Bailey | 24/16 PB |
| 4,272,047 | A | * | 6/1981 | Botka | 248/74.3 |
| 4,788,752 | A | * | 12/1988 | Kraus et al. | 24/16 PB |
| 4,862,560 | A | * | 9/1989 | Lichtenberg | 24/16 PB |
| 4,958,414 | A | | 9/1990 | Benoit | |
| 5,267,967 | A | | 12/1993 | Schneider | |
| 5,293,669 | A | * | 3/1994 | Sampson | 24/16 PB |
| 5,524,463 | A | | 6/1996 | Schenkel et al. | |
| 5,644,819 | A | * | 7/1997 | Lyons | 24/20 R |
| 5,704,097 | A | * | 1/1998 | Rahav | 24/16 PB |
| 5,724,707 | A | * | 3/1998 | Kirk et al. | 24/3.7 |
| 5,758,390 | A | | 6/1998 | Villeneuve | |
| 5,794,461 | A | | 8/1998 | Smith | |
| 5,901,416 | A | | 5/1999 | Mears | |
| 6,185,791 | B1 | | 2/2001 | Khokhar | |
| 6,185,792 | B1 | | 2/2001 | Nelson et al. | |
| 6,311,531 | B1 | | 11/2001 | Sykes | |
| 6,349,904 | B1 | * | 2/2002 | Polad | 248/74.3 |

* cited by examiner

*Primary Examiner*—James R. Brittain
(74) *Attorney, Agent, or Firm*—William Forster

(57) ABSTRACT

A releasable retaining clip comprising a locking head defining a passageway that extends from an entry point on the locking head to an exit point on the locking head. A pivotable locking member extends from the locking head into the passageway between the entry point and the exit point. The locking member is pivotable between a first blocking and locking position, to an unlocked position. A strap portion extends outward from the locking head, adjacent the entry point of the passageway. The strap portion includes a head end connected to the locking head, a tail end spaced from the head end, and a strap body that extends from the tail end to the head end. A locking seat is formed into the strap body for receiving the locking member when the tail end of the strap portion and the strap body of the strap portion are urged through the entry point into the passageway. The strap portion is movable from a first open position to engage an article, to a second closed position where the locking seat receives the locking member to lock the strap portion from reverse movement.

17 Claims, 3 Drawing Sheets

RELEASABLE RETAINING CLIP APPARATUS AND METHOD

This application claims the benefit of U.S. Provisional Application No. 60/372,725 filed Apr. 11, 2002.

BACKGROUND

This invention relates generally to straps and ties employed for binding, securing and retaining articles together, and more particularly to releasable locking retaining clips employed for releasably securing articles to belts and the like.

Retaining clips, ties and like devices have long been provided to bind items together and are well known in the art. Generally such clips and ties comprise a long strap member that forms a circular loop that connects back to itself, around one or more items to bind them together.

For example, some early ties including U.S. Pat. Nos. 3,872,547; 4,236,280; 4,272,047 and 4,688,302 issued between 1975 and 1987 and each incorporate straps that have a plurality of grooves for locking engagement with a integrally formed head. Each of these ties form generally round loops to bind a plurality of items, such as wire bundles, together, wherein the straps are pulled tight, thereby creating a substantial amount of tension. Because of their similar construction, where a substantially circular shaped loop is formed, each of these designs would make is difficult for a user to easily tie a single article to an item such as a belt, so that it lies flat, with little or no tension in the strap, to minimize catching on other structures.

Similarly, later designs, as illustrated in U.S. Pat. Nos. 4,825,156; 4,958,414; 5,267,967; 5,524,463, 5,758,390; 5,794,461 and 5,901,416 also incorporate straps that form a loop, however these designs also incorporate the feature of being releasable so that they can be reused. Typically, however, these patents illustrate a tie that either requires a special tool to release the strap, or the method of release is awkward and difficult to easily perform. Moreover, like the earlier designs, these form loops that are not adapted to lie flat.

Other more recent designs include U.S. Pat. Nos. 6,185,791; 6,185,792 and 6,311,531 wherein each disclose features similar to those found in the designs noted above, but are generally more complex in their construction, and may require specialized tools to implement their releasing feature.

Accordingly a need remains for a simple releasable retaining clip adapted to form a flat loop for binding pouches and the like to, for example, a belt or some other type of restraint. Additionally, a need remains for a retaining clip that can be released and reused without requiring special tools.

SUMMARY

One object of the invention is to releasably secure an article to another article, belt or the like.

A second object is to provide a releasable and reusable retaining clip.

Another object is to inexpensively fasten and retain one object to another object.

Yet another object is to provide a releasable retaining clip that is adjustable according to the size of object being retained.

A further object is to secure an article without creating shiny reflective surfaces.

Still another object is to provide a retaining clip that forms a substantially flat retaining loop to minimize snagging the same on other objects.

The invention is a releasable retaining clip for retaining and securing articles to a person or another article. For this purpose, the releasable retaining clip comprises a locking head that defines a passageway wherein the passageway extends from an entry point on the locking head to an exit point on the locking head. Importantly, a pivotable locking member is provided and extends from the locking head into the passageway between the entry point and the exit point. The locking member is pivotable between a first blocking, locking position, to an unlocked position.

In addition, a strap portion extends outward from the locking head, adjacent the entry point of the passageway. The strap portion includes a head end connected to the locking head, a tail end spaced from the head end, and a strap body that extends from the tail end to the head end.

Further, a locking seat is formed into the strap body for receiving the locking member when the tail end of the strap portion and the strap body of the strap portion are urged through the entry point into the passageway.

In operation, a user moves the strap portion from a first open position to engage an article to be secured, to a second closed position where the locking seat receives the locking member to lock the strap portion from reverse movement, i.e. back to the open position.

In another aspect of the invention the locking seat, formed into the strap body defines an aperture through which a release tool is directed to urge the locking member into the unlocked, unblocking position.

In another aspect of the invention the locking member defines a release cam surface, and the locking seat defines a inclined surface to engage the release cam surface as the strap body is urged through the locking head.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 5 is the first FIGURE in the series of FIGS. 5 through FIG. 8 which illustrates a sectional view of various stages of a tail end of a strap portion moving through the passageway of a locking head wherein FIG. 5 illustrates the tail end of the strap portion, just prior to the same moving into the passageway (as denoted by the arrow) of the locking head.

FIG. 6 is the second FIGURE in the series of FIG. 5 through FIG. 8 which illustrates a sectional view of various stages of a tail end of a strap portion moving through the passageway of a locking head, wherein FIG. 6 illustrates the tail end of the strap portion urging the locking member to the unlocked position.

FIG. 7 is the third FIGURE in the series of FIG. 5 through FIG. 8 which illustrates a sectional view of various stages of a tail end of a strap portion moving through the passageway of a locking head wherein FIG. 7 illustrates a locking member in the locked position within the first locking seat of the strap body with the locking surface of the locking member engaging the detent surface of the locking seat.

FIG. 8 is the forth FIGURE in the series of FIG. 5 through FIG. 8 which illustrates a sectional view of various stages of a tail end of a strap portion moving through the passageway of a locking head, wherein FIG. 8 illustrates a locking member being urged to the unlocked position by a release tool inserted through a release slot formed through the exterior surface of the locking head, the release tool extending through the aperture of the locking seat.

DETAILED DESCRIPTION OF PREFERRED EMBODIMENT

Figure 5:
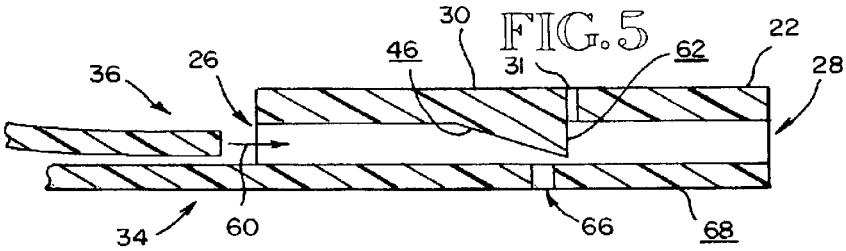
Figure 6:
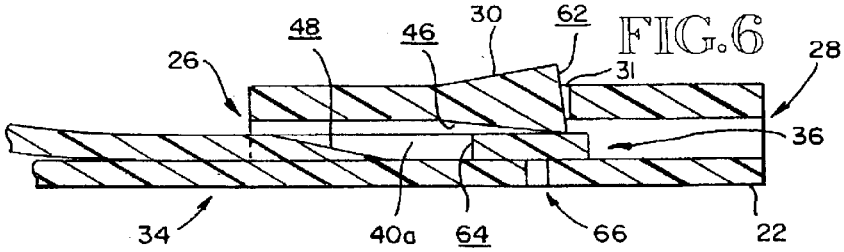
Figure 7:
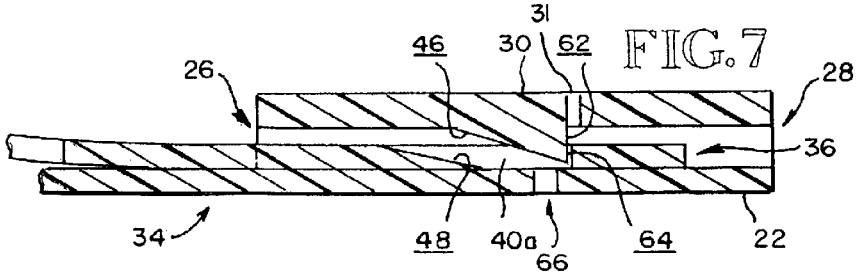
Figure 8:
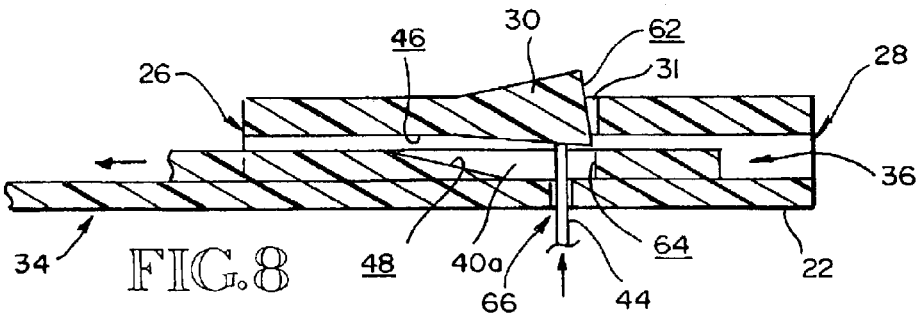
Figure 9:
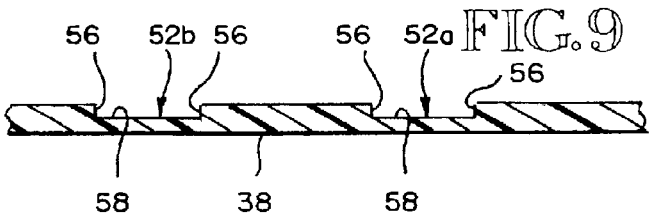
FIG. 9 is a fragmentary sectional view taken along line 9—9 illustrating a pair of spaced folding grooves formed on the inside surface of the strap portion.

Referring to FIGS. 1 through 9 of the drawings, numeral 20 generally designates a releasable retaining clip for retaining and securing articles, such as a pouch 21 to a belt 23 or another article. For this purpose, the retaining clip 20 comprises a locking head 22 that defines a passageway 24 wherein the passageway 24 extends from, and defines an entry point 26 on the locking head 22 to a spaced apart exit point 28, also defined by the passageway 24, on the locking head 22. Importantly, a pivotable locking member 30 is provided and extends from the locking head 22 into the passageway 24 between the entry point 26 and the exit point 28. The locking member 30 is pivotable between a first, blocking, locking position as illustrated in FIG. 7, to an unlocked position as illustrated in FIG. 8. In addition, it should be noted the locking member 30 is formed integrally with the locking head 22 by an opening 31 formed by removing material from the locking head 22.

In addition, a strap portion 32 extends outward from the locking head 22, adjacent the entry point 26 of the passageway 24. The strap portion 32 includes a head end 34 connected to the locking head 22, a tail end 36 spaced from the head end 34, and a strap body 38 that extends from the tail end 36 to the head end 34.

Further, a pair of locking seats 40*a* and 40*b* are formed into the strap body 38 for receiving the locking member 30 when the tail end 36 of the strap portion 32 and the strap body 38 of the strap portion 32 are urged through the entry point 26 into the passageway 24.

Figure 1:
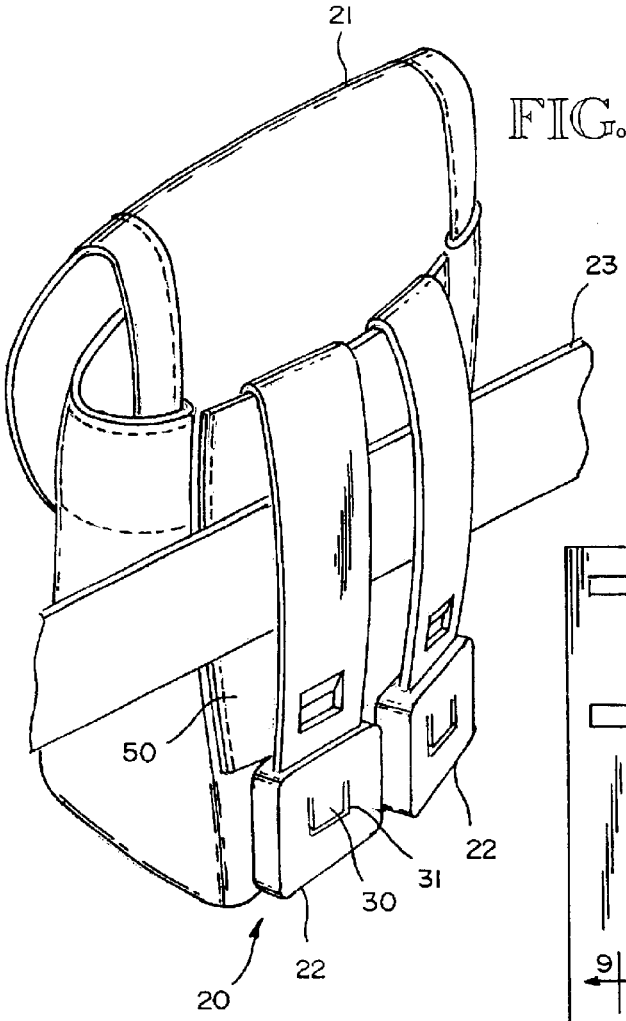
FIG. 1 is a perspective view of the preferred embodiment of two side by side retaining clips in the closed flat position securing a storage pouch to a belt of a user.
Figure 2:
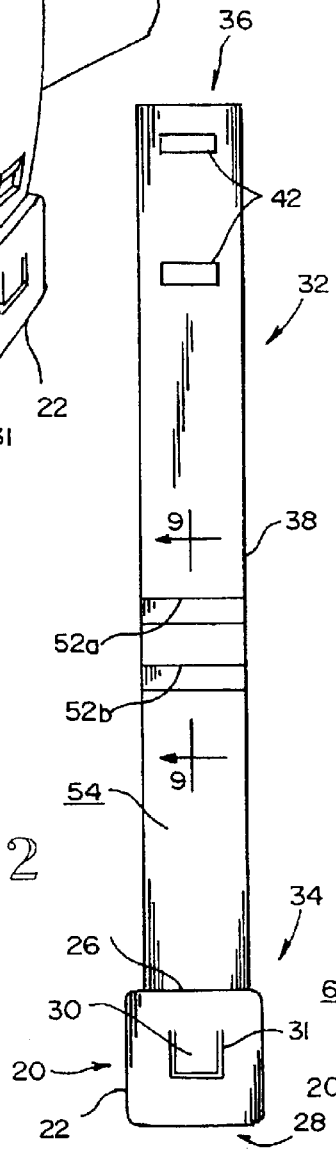
FIG. 2 is a view of a retaining clip in the open position illustrating the inside surface of the strap portion with two spaced folding grooves with the strap portion extending from a locking head.
Figure 3:
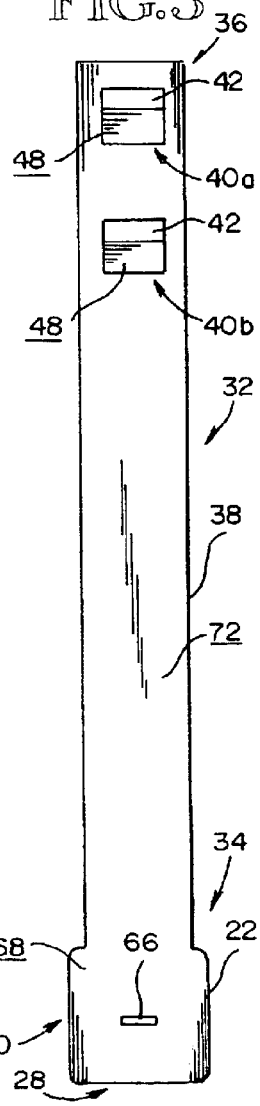
FIG. 3 is a view of a retaining clip in the open position illustrating the outside surface of the strap portion with the strap portion extending from the locking head wherein two locking seats are disposed adjacent the tail end of the strap portion.

In operation, a user (not illustrated) moves the strap portion 32 from a first open position as illustrated in FIGS. 2 and 3, to engage an article to be secured, to a second closed position (FIGS. 1 and 4) where the locking seat, either 40A or 40B, receives the locking member 30 to lock the strap portion 32 from reverse movement, i.e. back to the open position.

In another aspect of the invention each locking seat 40A and 40B, is substantially identical and formed into the strap body 38 to define an aperture 42 through which a release tool 44 is directed to urge the locking member 30 into the unlocked (unblocking) position so that the strap portion can be returned to the first open position.

Additionally, as will be more fully described below, the locking member 30 defines a release cam surface 46, and each locking seat 40A and 40B defines an inclined surface 48 to engage the release cam surface 46 as the strap body 38 is urged through the locking head 22. In this way, the locking member 30 pivots out of its "received position" within the locking seat so that the strap body can be urged further through the locking head 22.

Considering now in more detail the structure of the retaining clip 20, the preferred embodiment of the retaining clip 20 is constructed as one piece, and is molded from a high strength plastic such as "pellethane" which is a Dow Chemical brand of plastic. It should be noted however, that any other type of conventional resilient material or plastic could be employed in the manufacture thereof with equally satisfactory results.

Importantly, the present invention retaining clip 20 is arranged to form a substantially flat closed loop to enable a user to comfortably secure an article such as a pouch 21, via its mounting panel 50, as close as possible to a belt 23. Further, for certain extreme use situations, such as in the military, the retaining clip 20 must perform in a wide variety of situations with little possibility of failure. Accordingly, in the preferred embodiment, the retaining clip 20 is designed to quickly secure articles as needed by the user as well as disengaging or reversing the procedure with equal ease. To this end, the components of the retaining clip 20 are integrally formed. For example, the locking head 22 is integrally formed with a strap portion 32. Similarly, the strap portion 32 includes at least one integrally formed folding groove, either 52*a* or 52*b*, which is formed as part of the inside surface 54 transverse to the long direction of the strap body 38. In the present invention, each folding groove 52*a* and 52*b* is substantially identical, and formed with generally square surfaces, i.e., opposing groove sides 56 extending perpendicular from the groove bottom 58. However, other configurations for the groove would be acceptable including a "V" shaped groove (not illustrated).

Figure 4:
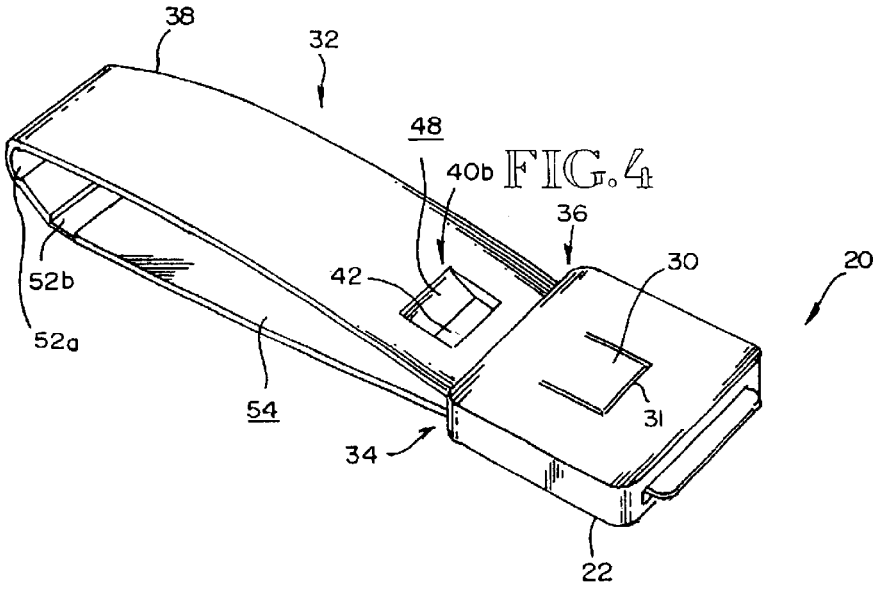
FIG. 4 is a perspective view of a retaining clip in the closed position with the first locking seat receiving and engaging the locking member.

As will be noted below, each folding groove 52*a* and 52*b* is provided to form a flexible hinge so that the strap body can fold over upon itself as illustrated in FIG. 4, i.e., the closed flat position for securing articles. In addition, each folding groove 52*a* and 52*b* is disposed at a predetermined distance from the locking head 22 so that each locking seat 40*a* and 40*b* corresponds to cooperate with either 52*a* or 52*b*. In other words, when the strap portion 32 is folded about folding groove 52*a*, locking seat 40*a* engages the locking member 30. Similarly, when the strap portion 32 is folded about folding groove 52*b*, locking seat 40*b* engages the locking member 30. Accordingly, for example, when the strap portion 32 is folded at folding groove 52*a*, the locking seat 40*a* is in proper position to receive the locking member 30 thereby allowing the same to assume the locked position, as illustrated in FIG. 7.

Directing attention to FIGS. 5 through 8, a series of sectional views illustrate various stages of a tail end 36 of a strap portion 32 moving through the passageway 24 of a locking head 22. Specifically, FIG. 5 illustrates the tail end 36 of the strap portion 32, just prior to the same moving into the passageway 24 (as denoted by the arrow 60) of the locking head 22. Similarly, FIG. 6 illustrates the tail end 36 of the strap portion 32 urging the locking member 30 to the unlocked position, i.e., the locking member 30 pivots away from the passageway 24, as the tail end 36 moves as indicated by arrow 60.

As the tail end 36 is urged further, as illustrated in FIG. 7, the locking member 30 shifts to the locked position within the first locking seat 40*a* of the strap body 38. Accordingly, a locking surface 62 of the locking member 30 engages a detent surface 64 formed by the locking seat 40*a*. In this way, the locking seat 40*a* is blocked from reverse movement, i.e., the strap body 38 is prevented from movement in a direction opposite to arrow 60.

Beyond this, FIG. 8 illustrates how the strap body 38 of a retaining clip 20 is returned to the open position. As illustrated, the locking member 30 is urged to the unlocked position by a release tool 44 inserted through a release slot 66 formed through the exterior surface 68 of the locking head. Accordingly, the release tool extends through the aperture 42 formed through the locking seat 40*a*. In this way, the locking member 30 can be pivoted away from the locking seat 40*a* thereby allowing the strap body 30 to be pulled back through the passageway 24.

As noted above, some retaining clips 20 comprise a strap portion 32 having more than one locking seat. For example, FIGS. 2 and 3 illustrate strap portions that have two alike locking seats 40*a* and 40*b*, and, as noted above, each correspond to one of two folding grooves 52*a* or 52*b*.

Importantly, when a strap portion 32 includes more than one locking seat, an exit point 28 is defined by the passageway 24 so that the tail end 36 of the strap portion 32 can extend therethrough.

Directing attention to FIG. 3, it should be understood that the outside surface 72 of strap portion 32 is flush with the locking head 22, and that the strap portion 32 extends therefrom in a direction generally parallel to the passageway 24. This construction facilitates a more flat configuration of the retaining clip 20 when the same in the closed position.

In addition to the above, it should be noted that each locking seat 40*a* and 40*b* are identical in construction and include an inclined surface 48 that slopes to a degree so that is substantially parallel to the release cam surface 46 of locking member 30. This construction is provided so that as the tail end 36 is urged through the passageway 24 according to arrow 60, the release cam surface 46 is smoothly pushed away from the locking seat 40.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A releasable retaining clip that forms an endless loop for retaining and securing articles, the releasable retaining clip comprising:

a locking head defining a passageway that extends from an entry point to an exit point;

a pivotable locking member that extends from the locking head into the passageway;

a foldable strap portion that extends outward from the locking head, adjacent the entry point of the passageway, wherein the strap portion includes a head end connected to the locking head, a tail end spaced from the head end, and a strap body that extends from the tail end to the head end;

at least one locking seat formed into the strap body for receiving the locking member when the tail end of the strap portion and the strap body of the strap portion are urged through the entry point into the passageway;

a predetermined number of folding grooves disposed in the strap body, equal to the number of locking seats, each folding groove being disposed so that it cooperates with a specific predetermined and corresponding locking seat; and wherein the strap portion is foldable about a specific folding groove from a first open position to engage an article to be secured, to a second closed position to form an endless loop as the strap body is urged through the entry point wherein the corresponding locking seat receives the locking member to lock the strap portion from reverse movement.

2. A releasable retaining clip as recited in claim 1 wherein a plurality of locking seats are formed into the strap.

3. A releasable retaining clip as recited in claim 2 wherein the distance between each folding groove and its corresponding locking seat is equal.

4. A releasable retaining clip as recited in claim 1 wherein each folding groove is formed integrally with the strap body.

5. A releasable retaining clip as recited in claim 1 wherein each folding groove is formed on the inside surface of the scrap body.

6. A releasable retaining clip as recited in claim 1 wherein the locking member extends in a direction substantially transverse to the direction of the passageway.

7. A releasable retaining clip as recited in claim 1 wherein each folding groove is formed transversely across the strap body.

8. A releasable retaining clip as recited in claim 1 wherein each locking seat defines an aperture through which a release tool is directed to urge the locking member into the unlocked position.

9. A releasable retaining clip as recited in claim 1 wherein the locking member defines a release cam surface, and each locking seat defines a inclined surface to engage the release cam surface as the strap body is urged through the locking head.

10. A releasable retaining clip as recited in claim 1 wherein the strap portion extends outward from the locking head in a direction substantially parallel to the passageway.

11. A method for making a releasable retaining clip that forms an endless loop for retaining and securing articles, the releasable retaining clip comprising:

forming a locking head to define a passageway that extends from an entry point to an exit point;

providing a pivotable locking member that extends from the locking head into the passageway;

forming a foldable strap portion that extends outward from the locking head, adjacent the entry point of the passageway, wherein the strap portion includes a head end connected to the locking head, a tail end spaced from the head end, and a strap body that extends from the tail end to the head end;

forming at least one locking seat formed into the strap body for receiving the locking member when the tail end of the strap portion and the strap body of the strap portion are urged through the entry point into the passageway;

forming a predetermined number of folding grooves in the strap body, equal to the number of locking seats, each folding groove being disposed so that it cooperates with a specific predetermined and corresponding locking seat; and wherein the strap portion is foldable about a specific folding groove from a first open position to engage an article to be secured, to a second closed position to form an endless loop as the strap body is urged through the entry point wherein the corresponding locking seat receives the locking member to lock the strap portion from reverse movement.

12. A method of making a releasable retaining clip as recited in claim 11 wherein a plurality of locking seats are formed into the strap.

13. A method of making a releasable retaining clip as recited in claim 12 wherein the distance between each folding groove and its corresponding locking seat is equal.

14. A method of making a releasable retaining clip as recited in claim 11 wherein each folding groove is formed integrally with the strap body.

15. A method of making a releasable retaining clip as recited in claim 11 wherein each folding groove is formed on the inside surface of the strap body.

16. A method of making a releasable retaining clip as recited in claim 11 wherein the locking member extends in a direction substantially transverse to the direction of the passageway.

17. A method of making a releasable retaining clip as recited in claim 11 wherein each locking seat defines an aperture through which a release tool is directed to urge the locking member into the unlocked position.

* * * * *